United States Patent [19]

St. Louis

[11] Patent Number: 4,966,499

[45] Date of Patent: Oct. 30, 1990

[54] VIBRATORY COMPACTOR

[75] Inventor: Paul T. St. Louis, Littleton, Colo.

[73] Assignee: FM Industries, Inc., Fort Worth, Tex.

[21] Appl. No.: 456,341

[22] Filed: Dec. 26, 1989

[51] Int. Cl.[5] ..... E02D 3/02; E01C 19/34

[52] U.S. Cl. ..... 405/271; 37/DIG. 18; 404/133; 405/258

[58] Field of Search ..... 405/271, 258, 128, 129, 405/303; 404/113, 117, 127, 133; 37/DIG. 18

[56] References Cited

U.S. PATENT DOCUMENTS

| | | | |
|---|---|---|---|
| 2,160,462 | 5/1939 | Schieferstein | 404/113 |
| 2,641,169 | 6/1953 | Ytterberg | 404/113 |
| 3,181,442 | 5/1965 | Brigel | 404/113 |
| 3,917,426 | 11/1975 | Wohlwend et al. | 404/133 |
| 4,224,003 | 9/1980 | St. Louis | 404/117 X |

FOREIGN PATENT DOCUMENTS

| | | | |
|---|---|---|---|
| 1404848 | 7/1975 | United Kingdom | 404/133 |

*Primary Examiner*—Dennis L. Taylor
*Attorney, Agent, or Firm*—Baker & Botts

[57] ABSTRACT

A vibratory compactor is connected to a loading boom for exerting compaction forces upon trash and the like. The vibratory compactor includes a generally circular base plate having outboard bearing members located near the periphery thereof, inboard bearing members extending across the central portion thereof stiffening the base plate, gussets connected thereto and extending toward the periphery of the base plate for stiffening the base and supporting inboard bearing members, and vibration isolating means located between the connectors used for connecting the compactor to the loading boom and the inboard and outboard bearing members.

17 Claims, 2 Drawing Sheets

VIBRATORY COMPACTOR

TECHNICAL FIELD OF THE INVENTION

This invention relates generally to vibratory compactors. More particularly, this invention relates to boom mounted vibratory compactors for use in the compaction of uneven materials such as trash.

BACKGROUND OF THE INVENTION

Prior constructed boom mounted vibratory compactors are illustrated in U.S. Pat. Nos. 3,917,426 issued Nov. 4, 1975 to Wohlwend, et al. and in 4,224,003 issued Sept. 23, 1980 to Paul T. St. Louis. Each of these patents illustrates hydraulic motor powered vibrating plate compactors which are primarily intended for compacting soil, gravel and the like. Each has the vibratory motor and vibration apparatus mounted on the base plate of the compactor and each includes apparatus for isolating the vibration from the boom while permitting the boom to load the compactor to press downwardly on the material being compacted.

The compactor illustrated in U.S. Pat. No. 3,917,426 includes four corner located elastomeric shear springs that are connected at their outboard ends near the periphery of the base plate. The inboard ends of the springs are connected to a connection member which joins the compactor to the boom. In U.S. Pat. No. 4,224,003, the vibratory compactor includes a centrally located upstanding support member mounted on the base plate to which the inboard ends of four elastomeric springs are connected. The outboard ends of the elastomeric springs are connected to the connecting members which join the vibratory compactor to the loading boom.

A comparison of the above devices illustrates that e compactor of U.S. Pat. No. 4,224,003 is basically centrally loaded, while the compactor of U.S. Pat. No. 3,917,426 is peripherally loaded. In both cases, the compactors are relatively small and are intended for the purpose of compressing or compacting materials that require a relatively high compaction pressure.

Recently, with the large amount of trash that must be moved from metropolitan areas, a need has arisen for some means for loading the trash into transporting vehicles such as trucks or railway cars and applying a force to such trash to compact it so that more trash can be carried by each vehicle. In addition to the desirability of having a much larger base plate for the faster compaction of the more easily compacted material, trash is frequently very uneven and non-homogeneous when dumped into the vehicle, thus the compactor must be capable of withstanding relatively high eccentric loading.

An object of this invention is to provide a vibratory compactor for use with loading booms that can be made relatively large and yet will withstand the eccentric loads encountered in compacting materials such as trash.

SUMMARY OF THE INVENTION

This invention, then, provides a vibrating plate compactor adapted for connection to and use with a loading boom in the compaction of uneven materials such as trash. The compactor comprises: a compactor base plate for engaging the trash; at least one inboard bearing member connected to and extending generally perpendicular from the base plate; a vibrator for introducing vibrations into the base plate that is mounted on the inboard bearing members; and outboard bearing members connected to the base plate adjacent to the periphery thereof. Each outboard bearing member has a surface that extends generally parallel to the inboard bearing member. The compactor also includes spaced connecting members that have bearing portions located between the inboard and outboard bearing members and that are arranged for connection to the loading boom. A load carrying, vibration isolating member connects each of the outboard bearing members to the adjacent bearing portions of the connecting members and connects each of the connecting members to adjacent ones of the inboard bearing members.

BRIEF DESCRIPTION OF THE DRAWING

The foregoing and additional objects and advantages of the invention will become more apparent when the following detailed description is read in conjunction with the accompanying drawing, wherein like reference characters denote like parts in all views and wherein.

DETAILED DESCRIPTION OF THE PREFERRED EMBODIMENT

Figure 1:
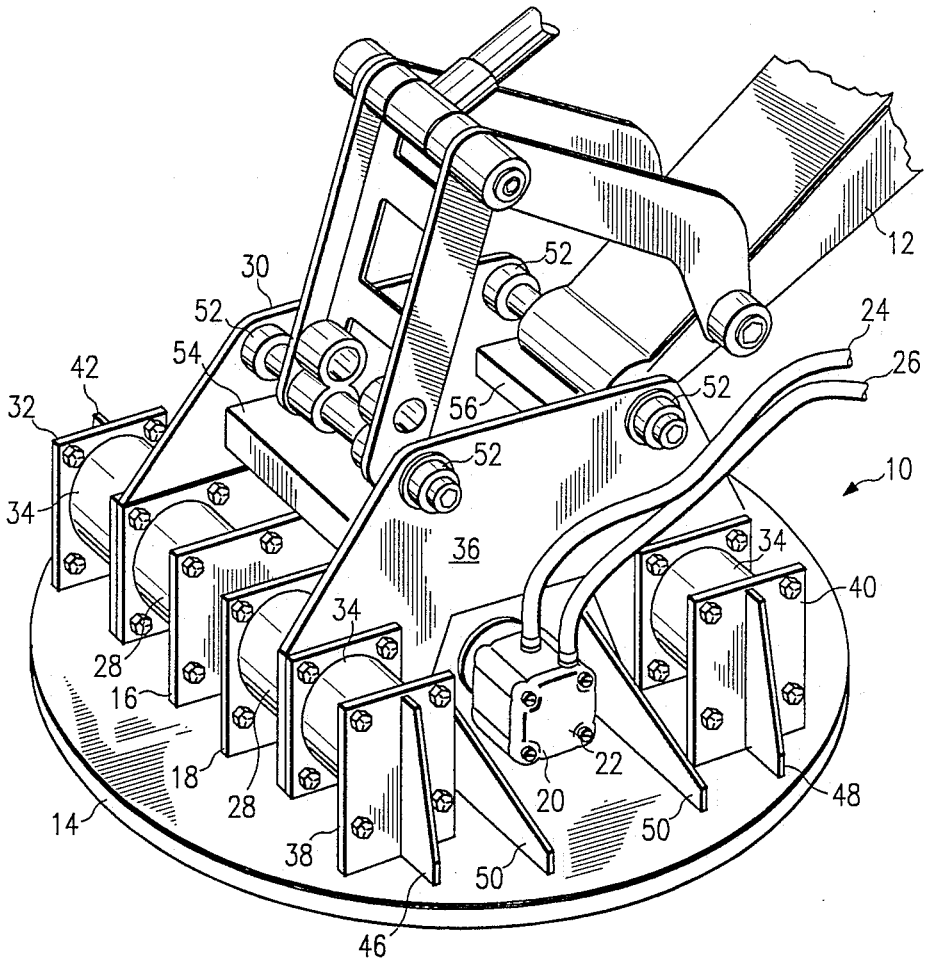
FIG. 1 is a pictorial view of a compactor that is constructed in accordance with the invention and shown connected to the end of a loading boom.

Referring to the drawing and to FIG. 1 in particular, shown therein and generally designated by the reference character 10 is a vibratory compactor that is constructed in accordance with the invention. As shown therein, the vibratory compactor 10 is connected to the end of a loading boom 12 that may typically be a backhoe (not shown) or the like. The compactor 10 includes a base plate 14 which is illustrated as being circular. However, the base plate 14 may be constructed in other configurations such as rectangular with rounded corners or as an oval.

Right and left upstanding inboard bearing members 16 and 18 are attached to the base plate 14. The bearing members 16 and 18, in addition to providing stiffening for the base plate 14, also support vibratory means 20 for imparting vibrations into the base plate 14. The vibratory means 20 may include any suitable type of rotating eccentric weight (not shown) that is driven by a hydraulic motor 22. Fluid under pressure for driving the motor 22 is provided through hoses 24 and 26 that can be connected to the source of hydraulic fluid in any suitable manner.

Right inboard bearing member 16 is connected by a vibration isolating member 28 to a right connection plate 30 which is in turn connected to an outboard bearing member 32 by a vibration isolating member 34. The members 28 and 34 have the capability, in addition to isolating vibration, of transmitting forces from the boom 12 to the base plate 14.

With the exception of the vibratory means 20, it will be apparent from viewing the various figures of the drawing that the compactor 10 is symmetrical or essentially symmetrical about an axis extending parallel to the inboard bearing members 16 and 18 and also about an axis extending generally perpendicularly therethrough and passing through the vibratory means 20.

Accordingly, it will be understood that there are four of the vibration isolators 28 and four of the vibration isolators 34 mounted across the front and rear of the compactor 10 in a relationship similar to that previously described.

Figure 2:
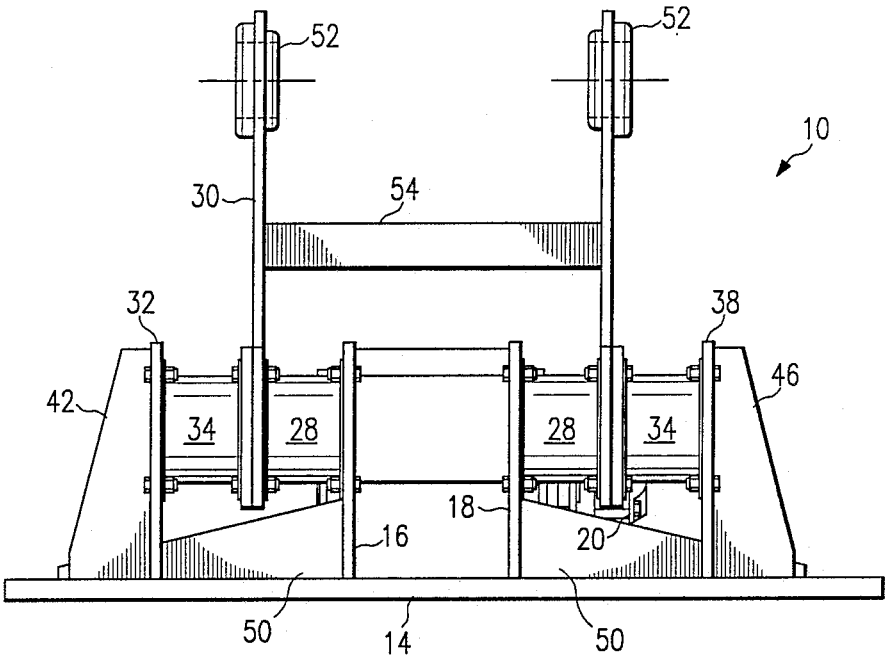
FIG. 2 is a front elevation view of the compactor FIG. 1.
Figure 3:
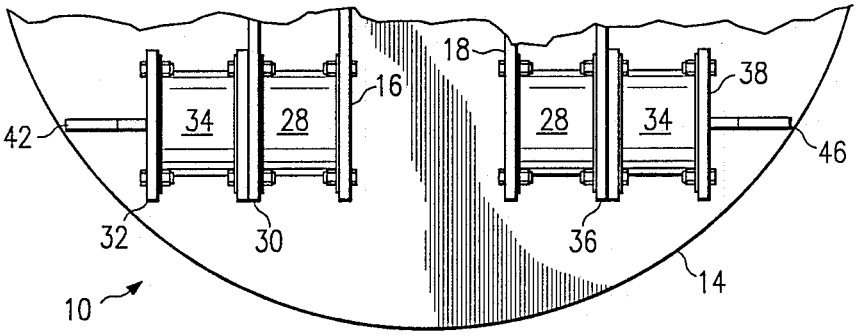
FIG. 3 is a fragmentary, top plan view of a portion of the compactor of FIG. 1.

The left inboard bearing member 18 is connected by isolation members 28 with a left connecting member 36. The left connecting member 36 is connected by isolation members 34 with outboard bearing members 38 and 40. It will be understood that although only three of the outboard bearing members 32, 38 and 40 are illustrated, a fourth member is provided which is hidden in FIG. 1 and not shown in FIGS. 2 or 3. It will also be understood that each of the outboard bearing members is essentially identical in construction.

Each of the outboard bearing members is provided with a respective stiffener member 42, 46 and 48 each of which is suitably secured, such as by welding, to the adjacent outboard bearing member 32, 38 or 40 and also welded to the base plate 14.

To provide additional stiffening to the base plate 14 and to aid in supporting the inboard bearing member 16 and 18, a plurality of gussets 50 have one end portion welded to the members 16 and 18 and their lower edge welded to the base plate 14. The members are substantially parallel and extend generally perpendicularly with respect to the inboard bearing member 16 and 18 and terminate near the periphery of the base plate 14.

The connecting members 30 and 36 are provided to join or connect the base plate 14 with the loading boom 12. Accordingly, the connecting members are each provided with appropriate members 52 for receiving the loading boom 12.

To provide additional rigidity to the compactor 10, a front cross member 54 extends between and is connected to the connecting members 30 and 36. Similarly, a rear connecting member 56 extends between and is also connected to the connecting members 30 and 36. The members 54 and 56 aid in preventing bending and twisting of the connecting members 30 and 36 when eccentric loads occur on the base plate 14.

OPERATION OF THE PREFERRED EMBODIMENT

When it is desired to utilize the compactor 10, the loading boom 12 is connected thereto in accordance with the requirements of particular loading boom involved. The hydraulic hoses 24 and 26 are connected so that hydraulic fluid under pressure will be supplied to the motor 22 to drive the vibrator (not shown), imparting vibrations to the base plate 14. The compactor 14 is elevated and set down upon a pile of trash with the vibration means 20 operating and the trash is compressed by the vibrating force of the compactor, by the weight of the compactor 10, and by the force that can be exerted thereon through the boom 12.

The area of the base 14 can be increased considerably over those of the prior art due to the use of the pairs of inboard and outboard vibration isolators 28 and 34 and due to the stiffening provided throughout the base plate 14 by the inboard bearing members 16 and 18, the gussets 50, and the outboard bearing members being located adjacent to the periphery of the base plate 14. The use of eight of the isolators permits the distribution and absorption of loads on the base plate even though such loads may be eccentrically applied. The shape of the base plate, that is being generally circular or at least having rounded corners, avoids corner loading and, thus, aids in avoiding high eccentric loading on the compactor. The rounded corners also reduce the possibility of the base plate becoming entangled with the non-homogeneous trash being compressed.

Having described but a single embodiment of the invention, it will be apparent that many changes and modifications can be made thereto without departing from the spirit or scope of the invention.

What is claimed is:

1. A vibrating plate compactor adapted for connection to and use with a loading boom in the compaction of uneven materials, such as trash, said compactor comprising:

a compactor base plate for engaging the trash;

at least one inboard bearing member connected to and extending generally perpendicularly from said plate;

vibratory means for introducing vibrations into said base plate mounted on said inboard bearing member;

outboard bearing members connected to said base plate adjacent to the periphery thereof, each having a surface extending generally parallel to said inboard bearing member;

spaced connecting members having bearing portions located between said inboard and outboard bearing members and arranged for connection to the loading boom; and a load carrying, vibration isolating member connecting each said outboard bearing member to the adjacent bearing portions of said connecting members and connecting each said connecting member to adjacent ones of said inboard bearing members.

2. The compactor of claim 1 wherein said base plate has rounded corners.

3. The compactor of claim 1 and also including a stiffener member connected to each outboard bearing member and extending generally perpendicularly therefrom, each said stiffener being connected to said base plate.

4. The compactor of claim 3 wherein said base plate is generally circular.

5. The compactor of claim 3 and also including at least one gusset member connected to each said inboard bearing member and connected to said base plate.

6. The compactor of claim 5 wherein said base plate is generally circular.

7. The compactor of claim 5 wherein each said gusset member extends toward and terminates proximate the periphery of said base plate for stiffening said base plate.

8. The compactor of claim 7 wherein said base plate is generally circular.

9. The compactor of claim 1 and also including at least one gusset member connected to each said inboard bearing member and connected to said base plate.

10. The compactor of claim 9 wherein each said gusset member extends toward and terminates proximate the periphery of said base plate for stiffening said base plate.

11. The compactor of claim 10 wherein said base plate is generally circular.

12. A vibrating plate compactor adapted for connection to and use with a loading boom in the compaction of uneven materials, such as trash, said compactor comprising:

a compactor base plate for engaging the trash;

a pair of spaced, generally parallel inboard bearing members connected to and extending generally perpendicularly from said base plate;

vibratory means for introducing vibrations into said base plate mounted on said inboard bearing members;

four, spaced, outboard bearing members connected to said base plate adjacent to the periphery thereof, each having a surface extending generally parallel to said inboard bearing members;

a pair of spaced, generally parallel connecting members having bearing portions located between said inboard and outboard bearing members and arranged for connection to the loading boom; and a load carrying, vibration isolating member connecting each said outboard bearing member to the adjacent bearing portions of said connecting members and connecting each said connecting member to adjacent ones of said inboard bearing members.

13. The compactor of claim 12 and also including a stiffener member connected to each outboard bearing member and extending generally perpendicularly therefrom, each said stiffener being connected to said base plate.

14. The compactor of claim 13 and also including at least one gusset member connected to each said inboard bearing member and connected to said base plate.

15. The compactor of claim 14 wherein each said gusset member extends toward and terminates proximate the periphery of said base for stiffening said base plate.

16. The compactor of claim 15 wherein said base plate has rounded corners.

17. The compactor of claim 16 wherein said base plate is generally circular.

* * * * *